US009060914B2

(12) United States Patent
Pidcoe et al.

(10) Patent No.: US 9,060,914 B2
(45) Date of Patent: Jun. 23, 2015

(54) SPASTICITY REDUCING CLOSED-LOOP FORCE-FEEDBACK CONTROL FOR POST-STROKE GAIT TRAINING

(71) Applicant: Virginia Commonwealth University, Richmond, VA (US)

(72) Inventors: Peter E. Pidcoe, Mechanicsville, VA (US); Jeffery A. Frankart, Mechanicsville, VA (US); Jessica Cortney Bradford, Bel Air, MD (US)

(73) Assignee: Viginia Commonwealth University, Richmond, VA (US)

( * ) Notice: Subject to any disclaimer, the term of this patent is extended or adjusted under 35 U.S.C. 154(b) by 148 days.

(21) Appl. No.: 13/889,650

(22) Filed: May 8, 2013

(65) Prior Publication Data

US 2013/0245511 A1 Sep. 19, 2013

Related U.S. Application Data

(63) Continuation-in-part of application No. 13/456,593, filed on Apr. 26, 2012.

(60) Provisional application No. 61/644,033, filed on May 8, 2012, provisional application No. 61/478,981, filed on Apr. 26, 2011.

(51) Int. Cl.

| | |
|---|---|
| ***A61H 1/00*** | (2006.01) |
| ***A63B 22/00*** | (2006.01) |
| ***A63B 22/06*** | (2006.01) |
| *A61H 1/02* | (2006.01) |
| *A63B 21/22* | (2006.01) |

(52) U.S. Cl.

CPC ..... *A61H 1/001* (2013.01); *A61H 1/0262* (2013.01); *A61H 1/0266* (2013.01); *A63B 21/225* (2013.01); *A63B 22/001* (2013.01); *A63B 22/0046* (2013.01); *A63B 22/0664* (2013.01); *A61H 2201/1215* (2013.01); *A61H 2201/164* (2013.01); *A61H 2201/5061* (2013.01); *A61H 2203/0406* (2013.01); *A63B 2022/002* (2013.01); *A63B 2022/0092* (2013.01); *A63B 2022/0094* (2013.01); *A63B 2022/067* (2013.01); *A63B 2220/13* (2013.01); *A63B 2220/16* (2013.01); *A63B 2220/51* (2013.01); *A63B 2220/54* (2013.01); *A63B 2220/805* (2013.01)

(58) Field of Classification Search

USPC ..... 482/1–9, 51, 52, 900–902; 434/247

See application file for complete search history.

(56) References Cited

U.S. PATENT DOCUMENTS

| | | | | |
|---|---|---|---|---|
| 5,954,621 | A * | 9/1999 | Joutras et al. | 482/114 |
| 7,160,230 | B2 * | 1/2007 | Tremblay | 482/52 |
| 7,163,492 | B1 * | 1/2007 | Sotiriades | 482/51 |
| 7,485,080 | B1 * | 2/2009 | Chuang et al. | 482/142 |
| 2005/0085344 | A1 * | 4/2005 | Eschenbach | 482/51 |
| 2007/0298935 | A1 * | 12/2007 | Badarneh et al. | 482/52 |
| 2009/0005222 | A1 * | 1/2009 | Liao et al. | 482/52 |
| 2011/0294624 | A1 * | 12/2011 | Burnfield et al. | 482/7 |
| 2012/0277063 | A1 * | 11/2012 | Zhang et al. | 482/8 |

* cited by examiner

*Primary Examiner* — Glenn Richman

(74) *Attorney, Agent, or Firm* — Whitham Curtis Christofferson & Cook, PC

(57) ABSTRACT

A robotic module which can be attached to an exercise apparatus provides enhanced physical therapy for victims of stroke or other maladies or accidents by simulating normal or arbitrarily modified profiles of angular position of an extremity such as a foot in accordance with a position of that extremity along a locus of repetitive motion. A closed-loop control system which is included in the module provides regulation which reduces or avoids spastic responses often found in poststroke patients during gait rehabilitation.

13 Claims, 5 Drawing Sheets

SPASTICITY REDUCING CLOSED-LOOP FORCE-FEEDBACK CONTROL FOR POST-STROKE GAIT TRAINING

CROSS-REFERENCE TO RELATED APPLICATIONS

This application is a continuation-in-part (CIP) application of U.S. Nonprovisional patent application Ser. No. 13/456,593, filed Apr. 26, 2012, which claims benefit of priority of U.S. Provisional Patent Application 61/478,981, filed Apr. 26, 2011. This application also claims benefit of priority of U.S. Provisional Patent Application 61/644,033, filed May 8, 2012, and the complete contents of these prior applications are hereby incorporated by reference in their entirety.

FIELD OF THE INVENTION

The present invention generally relates to exercise apparatus and physical therapy machines and, more particularly, to apparatus for physical therapy and exercise in regard to human ambulatory gait.

BACKGROUND OF THE INVENTION

In the course of a lifetime, a significant number of persons will suffer serious physical injuries and medical incidents and conditions which may be survivable and allow a degree of recovery but, nevertheless, leave a more or less intractable degree of impairment of some capabilities. Some injuries to the head and physical incidents such as stroke which cause some loss of some brain and/or spinal cord function are particularly serious and often result in disabilities or physical impairments which compromise or even preclude some activities which are extremely important and substantially essential to what is considered to be a reasonably normal and independently functional life style in a community.

Stroke is one of the leading causes of disability in the United States with roughly 750,000 individuals being affected each year. The yearly cost of stroke is estimated at nearly 30 billion dollars in direct medical costs and nearly 20 billion dollars is lost productivity. Many people who survive stroke are left with severe and persistent disabilities. Among these persistent conditions is hemiparesis, a weakness on one side of the body, which can impair the ability to walk. While the majority of stroke survivors will regain some limited ability to walk, 40% will require assistance with walking and, of those who eventually become independent, 60% will still achieve only limited community ambulation. Fewer than 20% of stroke victims will achieve unlimited community ambulation.

In a recent study, over 90% of stroke victims considered the ability to walk sufficiently to participate in the community to be important and 40% considered that capability to be essential. Therefore restoration of a walking gait is a major goal of rehabilitation of victims of stroke and accidents having similar hemiparetic effects.

Walking or gait is a person's natural way of moving from one location to another and is the most efficient way for a person to travel short distances. In a normally functioning person, the lower limbs have the ability to adapt to different surfaces, ground topologies and obstacles such as uneven ground or stairs. Because of the importance of walking, patients will generally strive to retain or regain the ability to walk, notwithstanding severe impairment.

In early human development, many skills involving more or less repetitive movements of limbs or coordination among muscle groups, such as speech and ambulation which are necessary to functioning in a community, are learned to the point of being almost reflexive in nature. Many more involving movement and/or coordination such as riding a bicycle, skating, sports skills and performing on musical instruments can also be learned to a similar degree. Such learning is sometimes colloquially referred to as "muscle memory". When a person having learned such skills suffers a stroke or injury causing hemiparesis, the muscles on one side of the body do not respond normally and impair the performance of such skills. Moreover, muscles on the impaired side of the body and the ability to control them may degenerate or atrophy from substantial disuse over a period of time and further impede recovery and the regaining of such skills.

It is well-established that repetitive movement against resistance can result in improved muscle tone and produce muscle growth as well as improve cardiovascular fitness even in persons of relatively advanced age. Movement against a weight is a classical form of such exercise. In recent years, many more or less sophisticated devices have been designed and built which not only provide such resistance in an easily controllable manner with reduced likelihood of injury but also allow some isolation of particular muscle groups during particular repetitive motions. Other types of exercise apparatus have also been developed to simulate some normal activities involving repetitive motion against resistance more or less closely. However, for normal persons, the degree of simulation of a normal activity is more important for the larger muscle groups to increase the exercise value of the repetitive motion against resistance than for the smaller muscle groups that would be important to the productive value of the activity that is being simulated. That is, some particulars of a complex repetitive motion being simulated may be altered in the interest of simplicity and/or robustness of the exercise apparatus or to place parts of the body at a relative mechanical disadvantage or to isolate particular muscle groups in order to maximize the exercise value of the motion but may be counterproductive in regard to the practice of activity, itself. In other words, use of exercise apparatus for development of the muscles involved in an activity does not necessarily improve the practice of the activity, itself, by the user of the exercise apparatus. Therefore, use of known commercially available exercise machines, while generally effective for obtaining maximal exercise value from their use, are of substantially reduced value in achieving rehabilitation of stroke or injury victims.

SUMMARY OF THE INVENTION

It is therefore an object of the present invention to provide an apparatus which closely replicates motions of a normal person performing a skill such as walking which can be used by a person suffering hemiparesis to guide movement of portions of the body in order to regain muscle tone and coordination for practice of basic skills.

It is another object of the invention to provide an apparatus for re-training of basic movement skills in which ankle angle movement patterns can be readily and easily altered and which can be manufactured by inexpensive modification of relatively inexpensive commercially available exercise equipment.

It is yet another object of the invention to reduce spasticity of muscular response in the course of re-training of basic movement skills.

In order to accomplish these and other objects of the invention, an apparatus is provided comprising in combination a mechanism for moving an extremity of a limb along a substantially elliptical locus, a sensor for determining locations of a portion of the mechanism along the substantially elliptical locus, an actuator for guiding a position of said extremity that simulates a repetitive motion of said limb corresponding to respective positions along said substantially elliptical locus, and a closed-loop control system which regulates an attenuation level of said actuator.

In accordance with another aspect of the invention, a robotic module for attachment to an exercise apparatus is provided comprising a sensor for determining locations of a extremity of a person along a substantially elliptical locus, an actuator for guiding a position of the extremity that simulates a repetitive motion of a limb corresponding to respective positions along said substantially elliptical locus, and a closed-loop control system which regulates an attenuation level of the actuator.

In accordance with a further aspect of the invention, a method of providing physical therapy using an exercise apparatus is provided comprising steps of guiding an extremity of a human body along a locus of substantially elliptical repetitive motion with the exercise apparatus and guiding angular position of the extremity in accordance with a position of said extremity along the locus of substantially elliptical repetitive motion, wherein said guiding angular position step is regulated by a closed-loop control system.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION

Figure 1:
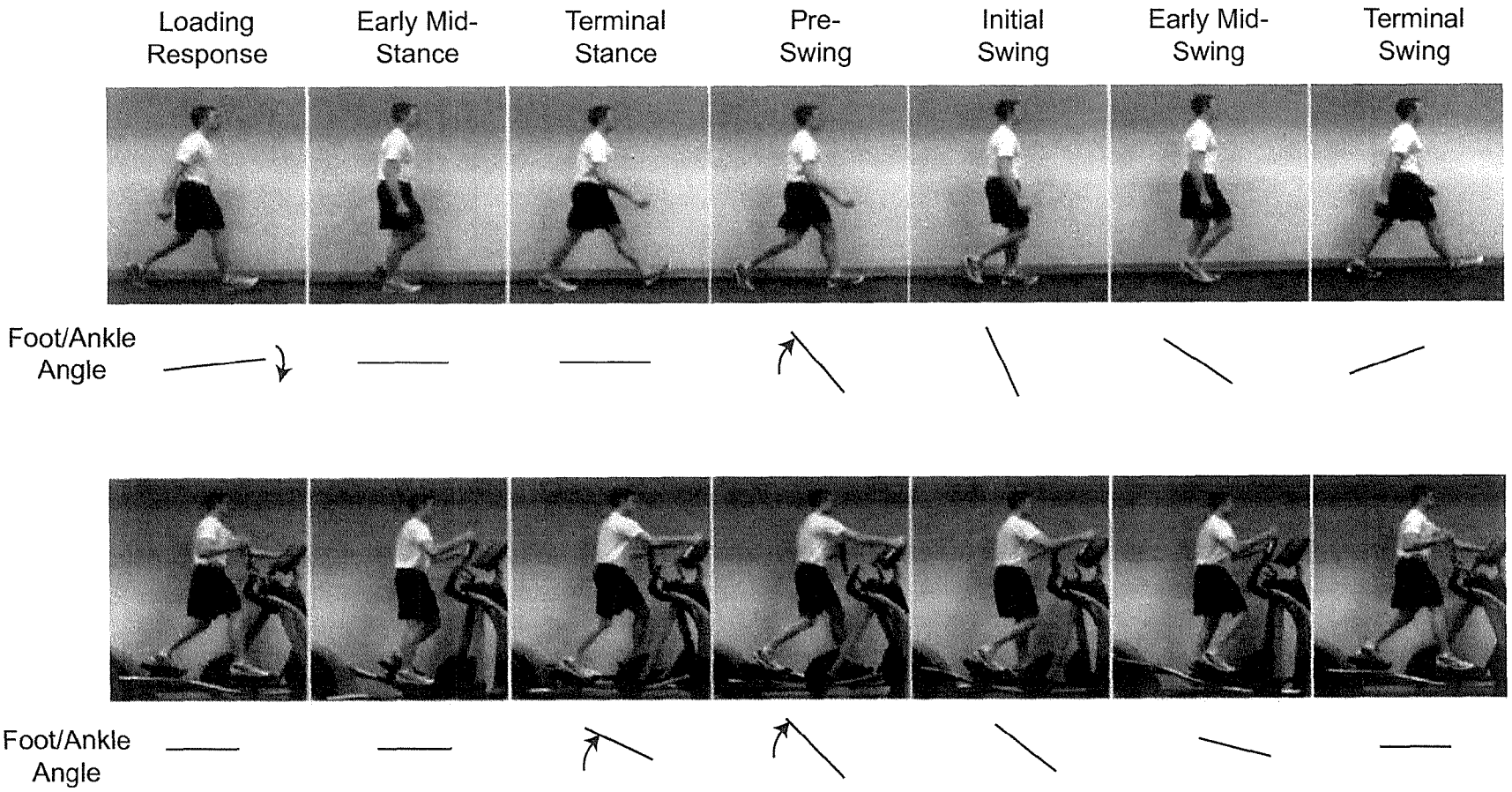
FIG. 1 is a comparison of two sequences of photographs comparing relative body kinematics during normal walking on a level surface and using an elliptical trainer type of exercise machine.
Figure 2B:
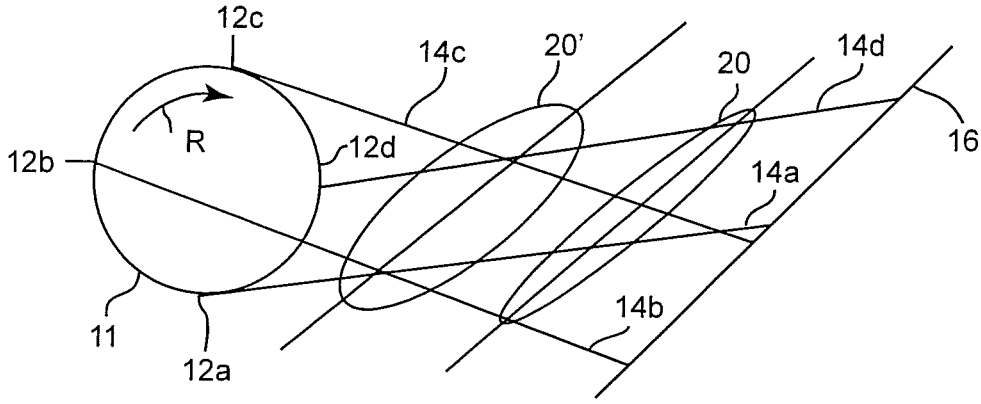
FIG. 2B is a diagram useful in understanding how a substantially elliptical motion is developed by a elliptical trainer mechanism.
Figure 2A:
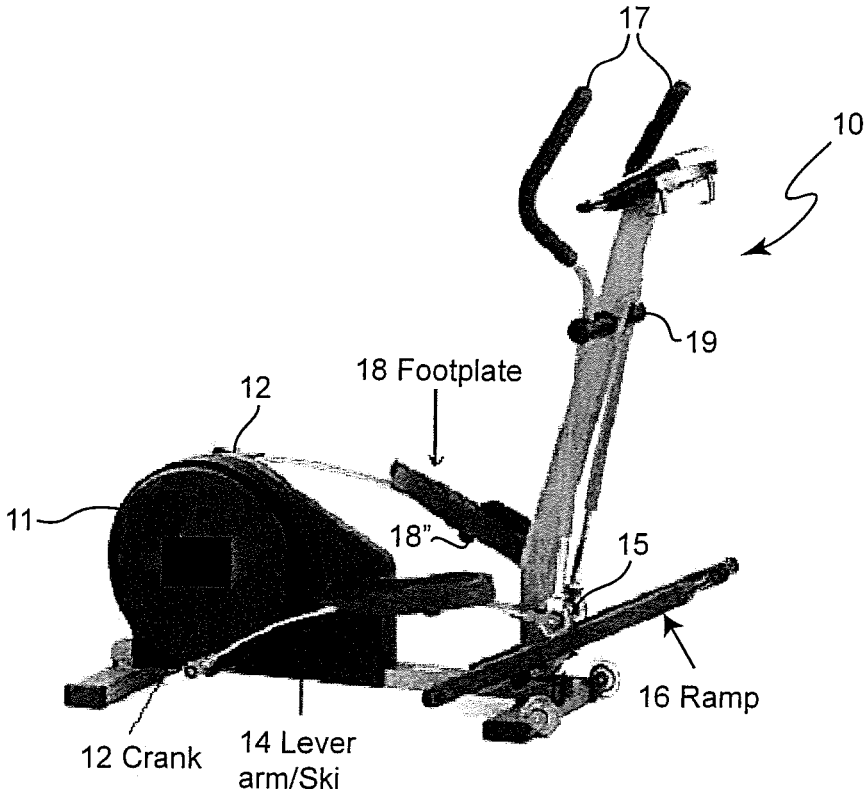
FIG. 2A is an oblique view of a type of elliptical trainer suitable for modification in accordance with the invention.

Referring now to the drawings, and more particularly to FIG. 1, there is shown two sequences of photographs of the same subject performing a sequence of motions representing one cycle of a walking gait. (as a matter of terminology, the term "gait cycle" refers to a complete motion involving both feet and legs that is repeated in its entirety during walking while the term "step" refers to either the loading and stance phase or the swing phase of a gait cycle as illustrated in FIG. 1 and thus is approximately one-half of a gait cycle in duration. The term "stride" generally refers to the nature or length of a step or gait cycle and thus may be somewhat ambiguous in regard to various aspects of the invention and will not be used in the following discussion of the invention.) While the invention is not depicted in the photographic sequences of FIG. 1, the photographs and the sequences are selected and arranged and indicia applied thereto to facilitate an understanding of the problem addressed and solution provided by the invention. Further, while the elliptical trainer apparatus depicted in FIG. 1 is of a known type, it may have been set-up, adjusted or slightly modified for the subject of the photographs of FIG. 1 in order to maximize similarity to a normal walking motion in the interest of better conveying an understanding of the invention. Therefore, no part of FIG. 1 or FIGS. 2A or 2B is admitted to be prior art in regard to the present invention.

The first sequence depicts normal walking on a level surface. The second sequence depicts a walking motion executed on a commercially available Nordic Trak™ CXT 910 elliptical trainer apparatus. Elliptical trainer apparati are types of device which cause the load-bearing extremity of the user to follow a generally elliptical path simulating a repetitive motion of a normal and common activity such as walking. The generally elliptical path of, for example, the right foot of the subject in these sequences of photographs, captured with a video camera, can be observed in both sequences of photographs.

The individual photographs in each sequence correspond to the respective photograph in the other sequence and correspond to identifiable points within a gait cycle which are of particular interest, as will be discussed below and are not necessarily equally separated in time as will also be further discussed below. These points in time are, from left to right:

1.) the loading response (when body weight is shift to a particular foot),
2.) early mid-stance) when body weight is directly over one foot),
3.) terminal stance (when body weight is about to be removed from that foot but the foot remains fully in contact with the supporting surface),
4.) pre-swing (as weight is removed from that foot to be transferred to the other foot as the heel of the foot is lifted and the body is thrust forward by the grip of the toes),
5.) initial swing (as the foot begins to move forward),
6.) mid-swing as the lifted foot passes the other, load-bearing foot, and
7.) terminal swing (at the moment of heel contact prior to shifting of weight when the loading response point in the gait is repeated at the beginning of the next gait cycle).

It should be noted that these points in time are identified for each foot of the subject and the particular identified point in the gait cycle for one foot will correspond to another identified point in the gait cycle for the other foot. For example, the loading response point in the gait sequence for the right foot will correspond to the pre-swing point in the gait cycle for the left foot. It should also be understood that, while the respective photographs in each sequence correspond to each other, they do not necessarily correspond to the same points in time as a percentage of a gait cycle.

It can be seen from the photographic sequences of FIG. 1 that the thigh and shin positions and the hip and knee angles during a gait cycle correspond closely to each other in the two sequences of photographs. Thus, as alluded to above, it can be concluded that the elliptical trainer depicted in these photographs can provide exercise very similar to walking and similarly effective in regard to the exercise of large muscle groups of the lower torso and upper legs as the activity that is simulated. However, as also alluded to above, the position of the foot and the ankle angle in the sagittal plane (e.g. extending in a vertical and front-to-back directions with respect to the human body) differs significantly from the positions and angles (indicated for the right foot of the subject below each Photograph in both sequences; positive or toe-up angles being referred to as dorsiflexion and negative or toe-down angles being referred to as plantarflexion) that occurs during normal walking on a level surface where the body is propelled forward by the engagement of the ball and the toes of one foot immediately before body weight is shifted to the other foot although propulsion of the body during the stance phases of the gait by the motion of the thigh and the change of knee angle appears to be accurately simulated.

The angle of the foot with respect to the horizontal direction in the sagittal plane is graphically plotted as a function of a percentage of a single gait cycle in FIG. 3 for each of the respective photographic sequences of FIG. 1, as will be discussed in greater detail below. The foot/ankle angles with respect to the horizontal direction in the sagittal plane for normal walking on a level surface are depicted by curve 32 while the foot/ankle angles with respect to the horizontal direction developed by a commercially available elliptical trainer for simulation of walking are indicated by curve 34. At this point in the discussion of the problems addressed by the invention, it is only important to note that the foot/ankle angles developed by a commercially available elliptical trainer for simulation of walking (to which the following discussion will be confined although elliptical trainers for simulation of other activities exist or could be developed using the same mechanical principles) are much smaller in total angular excursion, are much more regular (approaching a sinusoid) and, very importantly, are delayed in phase from ankle flexure during normal walking.

Referring now to FIGS. 2A and 2B, the operation and development of the indicated foot/ankle angles during a gait cycle by a commercially available elliptical trainer 10 will now be discussed. Specifically, elliptical trainer 10 includes a flywheel 11 at a rear portion thereof that carries cranks 12 at diametrically opposite locations on opposite sides thereof. The flywheel is supported in a manner (e.g. circumferential bearings, a short axle between two disks or the like) which does not interfere with cranks 12 but is otherwise unimportant. One end of each of a pair of lever arms 14 (sometimes referred to as skis) 14 are attached to the respective cranks 12. The opposite ends of the lever arms 14 are terminated in low friction bearings, in this case, wheels 15; the constitution of which is also unimportant. Wheels 15 are supported by an angled ramp 16 and, as flywheel 11 turns or is turned, the ends of the lever arms 14 essentially ride up and down along the angled ramp 16. The lever arms 14 are preferably in the form of and constituted by arcuate leaf springs and the footplates 18 attached at locations on the lever arms which are adjustable and can be set at suitable locations by, for example, a knob 18' connected to a screw (not visible in FIG. 2A). Thus, the leaf spring lever arm 14 and adjustable location footplate 18 provides some degree of flexibility and cushioning for a user while allowing some adjustability of the basic angle as well as the location at which the footplates 18 are set as well as a degree of adjustment of the angle and eccentricity of the elliptical motion developed at the footplate.

While not important to the invention, the elliptical trainer illustrated in FIG. 2A also includes pivoted handlebars 17 which are connected to the wheels 15 (or the lever arms 14 at the approximate location of wheels 15. The handlebars telescope in length below pivot 19 to accommodate the sloping ramp 16. The principal function of handlebars 17 is to provide a structure for the user to grip during use, for user stability, and to impart a rotating flexure of the arms and torso that provides a degree of resistance exercise to the upper body. The pivoting handlebars are otherwise unimportant to the invention.

The development of an elliptical motion can be readily seen from FIG. 2B in which only one lever arm 14 is depicted for clarity and simplicity of discussion. The other lever arm operates identically but precisely out of phase (e.g. by a phase difference of 180°, referred to rotation of flywheel 11) with the other. As the circular flywheel rotates in the direction of curved arrow R, each of the cranks 12 traces a circular locus and sequentially assumes the exemplary positions 12*a*, 12*b*, 12*c*, and 12*d* and moves one end of the lever arm 14 accordingly. The opposite end of the lever arm 14 follows a path defined by ramp 16, the angle of which is preferably adjustable, as defined by whatever bearing structure such as wheel 15 is employed. Neglecting the preferred curvature of the lever arm 14, lever arm 14 will assume a sequence of positions 14*a*, 14*b*, 14*c* and 14*d*. Thus, footplate 18 which is attached to a given point along the length of the lever arm 14 will follow a generally elliptical locus 20, 20' having a major axis generally parallel to the ramp 16 (the angle of which is substantially exaggerated in FIG. 2B, for clarity of illustration while a much shallower angle nearly parallel to the surface supporting the apparatus would normally be used for practice of the invention) and increasing in eccentricity with distance from the flywheel 11 or crank 12.

It should be appreciated that the bottom half of a highly eccentric ellipse when the major axis of the ellipse is brought near horizontal through use of a small angle of inclination of the ramp 16 and allowing for some flexure of the leaf spring of the lever arm 14 under loading from the weight of the user, is relatively flat and thus closely approximates the loading response, stance and preswing phases of a gait cycle while the upper half of the ellipse closely approximates the locus with respect to the body through which the foot travels during the swing phases of a gait cycle. This geometry has the effect of dividing the gait cycle substantially evenly with the stance and swing phases each comprising about 50% of the gait cycle. In normal walking, however, the stance phases comprise about 60% of the gait cycle while the swing phases are somewhat shortened to about 40% of the gait cycle. While some commercially available therapy apparatus has attempted to increase fidelity of movement to the unequal durations of the stance and swing phases of the gait cycle through complex differential gearing arrangements and/or electronic controls (adding substantial cost and weight to the apparatus) it appears to the inventors that this discrepancy between the elliptical trainer motion and normal walking is of little, if any, importance to effectiveness of therapy and that, once sufficient coordination and muscle strength have been regained, the body will reflexively shorten the swing phase of normal walking in order to increase the duration that both feet are in contact with the surface being traversed and to more readily maintain balance.

In contrast, it should be noted that the crank positions 12*a*-12*d* do not correspond to the either extreme top, bottom front and back of the elliptical locus or the extremes of inclination of the lever arm 14. Thus there is an unavoidable phase discrepancy between the cyclic foot position and ankle angle established by the elliptical trainer apparatus and the foot position and ankle angle (referred to a horizontal direction) that is established by contact of the foot or a portion thereof and a level surface. As alluded to above, this phase discrepancy can be clearly observed from curves 32 and 34 of FIG. 3. This phase discrepancy, while acceptable and possibly beneficial as an incident of exercise, is considered to be extremely counterproductive in the therapeutic re-training of basic movement skills, particularly since it is inconsistent with the coordination of movements involved in such skills.

Figure 4:
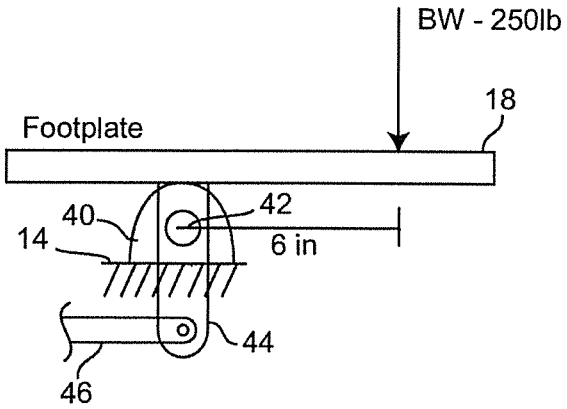
FIG. 4 is a side view of a portion of the invention useful in explaining design features thereof.

Since this phase discrepancy is substantially inherent in the geometry of elliptical training apparatus, the foot/ankle angle must be decoupled from the apparatus which produces the elliptical movement that causes the desirable shin, knee, thigh and hip to move in a manner which closely mimics movements of walking on a level surface. Accordingly, the invention provides for the footplate 18 to be pivoted from a member 40 that is raised from the lever arm 16 as shown in FIG. 4 in which the footplate is pivoted from a shaft 42 and the angle of the footplate can be controlled by a controls arm 44 and a pushrod arrangement generally depicted at 46. The height of member 40 for the most economical construction (e.g. a modification of a relatively inexpensive commercially available exercise machine) is a trade-off between the angle of plantarflexion that can be achieved without mechanical interference of the footplate 18 with the lever arm 14 and the additional height of the footplate location which may increase difficulty of a user becoming properly positioned on the apparatus. It is considered that a minimum total angular footplate movement of 30° should be provided. This mechanical interference problem could be avoided by, for example, modification of the lever arm by providing two lever arms attached to each crank and allowing the end of the footplate to move between them at large plantarflexion angles but substantial cost would be incurred in such an additionally modified structure.

As a further incident of design, it is considered that a stroke victim would probably undergo a prolonged period of substantial immobility prior to being able to undergo therapy using the invention and therefore may be of greater than normal body weight, assumed to be 250 pounds for purposes of a practical design of an embodiment of the invention. Since substantially the entire body weight of a user must be carried by each footplate as the user shifts body weight between footplates in the course of a walking gait and may be applied to the footplate through the ball of the foot and the toes, it is considered that such a structure should be able to carry full body weight at a point about six inches away from the desired ankle location relative to the footplate 18 which, in turn, should be substantially aligned with the pivot location 42. Therefore, the arrangement of FIG. 4 including control arm 44 (which should be limited in length for the same reasons member 40 is limited in height, as discussed above) and pushrod 46 should be designed to bear at least about 125 foot-pounds of torque.

Figure 3:
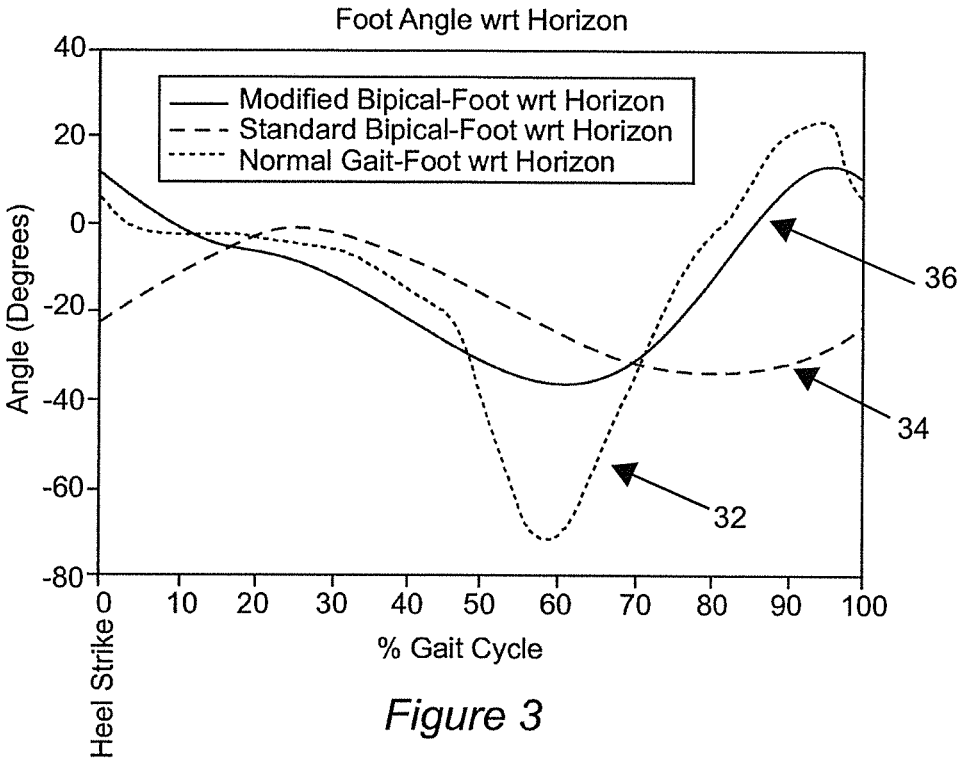
FIG. 3 is a graphical comparison of ankle angle (in the sagittal plane) during a single gait period of normal walking on a level surface and use of an elliptical trainer as in the photograph sequences of FIG. 1 with the ankle angle achieved by the invention superimposed thereon.

The maximum speed of rotation of footplate 18 around pivot point 42 corresponds to the slope of profile 32 of FIG. 3. Based on a gait cycle frequency of one gait cycle per second, the maximum rotational speed through a required change of footplate angle is about 22 rpm. In this regard, it should be appreciated that the phase discrepancy discussed above could be remedied by an extension of crank 12 to form an additional crank of different phase or a cam arrangement for control of the pushrod arrangement 46. However, it has been found that such structures cannot be made adequately robust to bear such weights and generate such torque levels to provide the required rapid changes in footplate angle without adding unacceptable amounts of weight and cost to the apparatus. Further, such cranks while capable of altering phase of changes in ankle angle, cannot change the profile of the ankle angle change from a substantially sinusoidal shape. A cam arrangement, while capable of altering the profile of the ankle angle profile is necessarily limited to a single profile and would require substantial effort to change from one profile to another.

Figure 5:
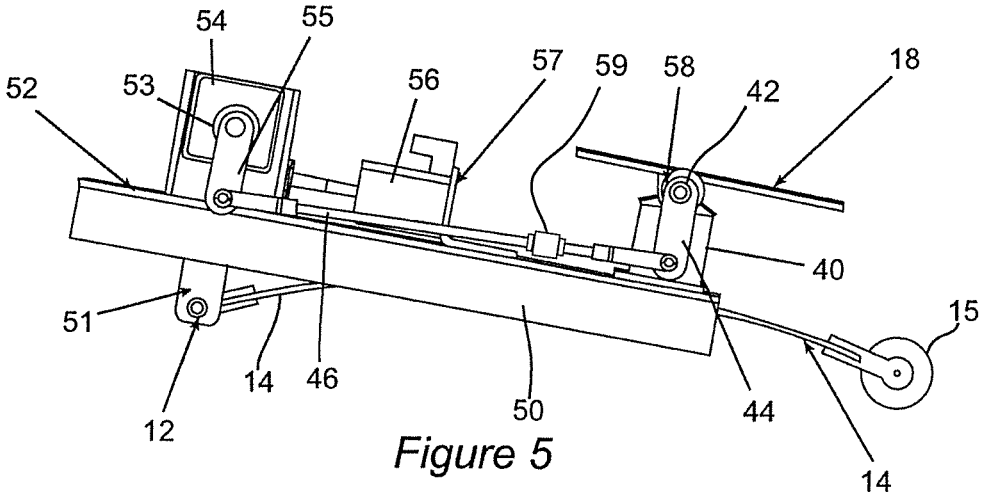
FIG. 5 is a side view of the invention as applied to the elliptical trainer of FIG. 3.

Accordingly, the preferred embodiment of the invention is shown in FIG. 5. It should be kept in mind that a principal object of the invention is to provide an apparatus capable of providing highly effective therapy but to do so with minimal cost and apparatus weight. For comparison, a special purpose therapy apparatus is commercially available which closely controls movement of the hips, legs and feet to establish a walking gait but is of substantial weight and costs well in excess of one hundred thousand dollars. The present invention provides numerous advantages over such a device as will be discussed in greater detail below but is limited in cost to the cost of a commercially available elliptical trainer that can be obtained for substantially less than one thousand dollars and suitably modified in accordance with the preferred embodiment of the invention for an additional cost of about two thousand dollars. Therefore, it should be understood that the embodiment of the invention illustrated in FIG. 5 is preferred based, in large part, on cost and weight while many modifications could be made in the preferred embodiment of the invention without departing from the spirit and scope of the invention. It is also considered important to limiting cost and weight of modifications of commercially available exercise machines to provide a therapy apparatus, to arrange the elements of the invention in a substantially modular form that can be easily attached to an existing exercise machine.

The preferred embodiment of the invention comprises a body 50, preferably in the form of a beam with downwardly extending flanges, presenting a flat upper surface and having a width somewhat in excess of the width of the arcuate lever arm 14 such that the beam flanges extend along the sides of the lever arm in order to laterally position body 50 thereon. A pair of downwardly extending brackets 51 are provided, preferably as extensions of the flanges of the beam to engage crank 12. The brackets 51 are positioned such that the beam will be tangent to the arcuate lever arm 14 at the location of member 40 providing a raised pivot point 42 for footplate 18. Thus lever arm directly supports the footplate through member 40 and body 50, providing extremely stable support for a user.

The flat upper surface of body 50 is preferably covered with a vibration absorbing (preferably rubber) material layer 52 to limit conduction of vibration from an actuator such as gear box 54 and motor 56 either directly or through motor mount 57. As will be discussed in greater detail below, motor 56 is preferably a servo motor, although a stepping motor of possibly other types of actuators could theoretically be used. A servo motor can produce substantially greater torque than a stepping motor of comparable weight, generates less rotational vibration and is somewhat more easily controlled. Thus a servo motor is preferred for practice of the invention. The gear box 54 preferably houses a worm gear meshed with a sector of a pinion gear. The preferred gear ratio is 60:1 which is effectively self-locking when not being driven by the servo motor and can operate with zero backlash through preloading. The high gear ratio also provides for multiplication of servo motor torque to drive control arm 55, pushrod 46 and control arm 44 which alters the angle of footplate 18. A ball bearing 58 is preferably provided for the pivot bearing of the footplate, again to avoid vibration and, importantly, any lost motion or free play in the pivot joint that would compromise stability of the footplate.

During gait rehabilitation, spastic responses are often experienced by users. This spasticity occurs secondary to loss of upper motor neuron inhibition. Rehabilitative gait training attempts to simulate normal gait kinematics, kinetics, and muscle firing patterns. Deviations from this pattern are thought to slow functional return. Spastic reflexes are not a component of normal gait and thus should be reduced during training.

A spastic response can result in ankle plantar flexion (PF) with weight-bearing and may result from spasticity forced dorsiflexion (DF) movement during the "pre-swing" phase of the gait cycle. The invention reduces or avoids spastic response in a user by providing a closed-loop control system which modulates the DF amplitude and velocity. Reduction of DF amplitude and velocity reduces spasticity but can also makes the gait pattern kinematically less "normal". The closed-loop control system comprises hardware and software (e.g. a force-feedback algorithm) that uses input of sagittal plane ankle torques to modify the movement pattern of the footplates in a way that reduces spasticity while minimizing the impact on normal gait kinematics.

One or more load cells or force transducers 59 are preferably provided in series with the pushrod 46 between the gearbox 54 and footplate 18 to measure the footplate force and measure/calculate sagittal plane ankle torques. That is, the force transducers determine the force load experienced by the footplate from the user's foot. Force transducers which are suitable for practice of the invention are known in the art, for example Interface SSM-500 load cells (Scottsdale, Ariz.). The load cells measure the amount of force required to move the footplate during a programmed motion profile.

The present device measures spasticity via force feedback. Additional features may include additional load measuring instrumentation to also measure left-right weight shifts, pressure patterns on the foot, etc.

Figure 6:
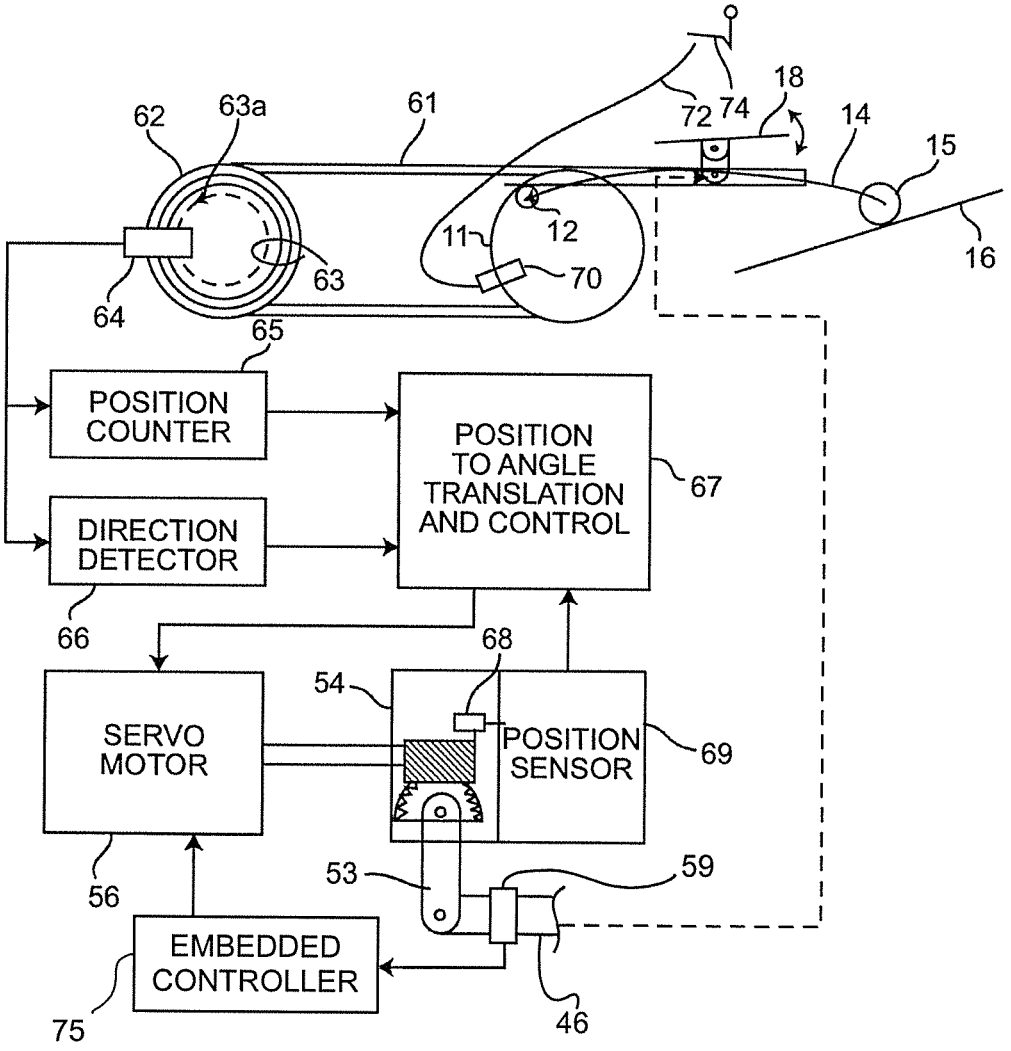
FIG. 6 is a high-level block diagram of an arrangement for operation of the therapy apparatus in accordance with the invention.

Referring now to FIG. 6, an exemplary arrangement for control of the therapy apparatus in accordance with the invention will now be discussed. As described above, the rotational position of flywheel 11 controls the location of the lever arms which, in turn, controls the position along the elliptical locus of motion of the footplates 18. To track the rotational position of flywheel 11, an encoder disk 62 is driven by flywheel 11. A belt drive arrangement 61 is currently preferred for ease of setting or modifying the phase of the ankle angle profile but an encoder disk or stripe could be provided on the flywheel, itself, or on a structure carried by the flywheel. The encoder disk is provided with three tracks 63 of detectable indicia or structures, preferably in a known manner in which two of the three tracks include many (e.g. 2000 indicia or structures yield a rotational resolution of about 0.25° which is entirely adequate for practice of the invention) closely spaced indicia or structures with a slight skew between the positions of the indicia or structures in the respective tracks to allow determination of direction of rotation and a third track with fewer (possibly only one) indicia 63*a* that can be used for indexing. These indicia or structures are detected by a suitable sensor 64, the particulars of which are unimportant to the invention or practice thereof. A position counter 65 is reset when the index indicia or structure is detected and the rotational position is preferably determined by a position counter 65 for counting the indica or structures as they pass sensor 64. The direction of rotation is detected by the relative phase of the indicia or structures in the first two tracks by direction detector 66 and the position counting is accordingly controlled to be incremental or decremental.

The position indicated by position counter 65 can then be translated to an ankle angle by any of a number of types of device such as a look-up table, a microprocessor performing a computation in accordance with an algorithm or even an optical reader that simply follows the edge of a structure shaped in accordance with the desired ankle angle profile (e.g. 36 in FIG. 3). The high resolution provided by the position encoding arrangement tends to keep the footplate in smooth and substantially continuous motion so that no significant vibration is caused as the footplate is angularly moved. The most important feature of this translation is that the mechanism of translation should be able to accommodate any desired foot/ankle angle profile that may be desired or deemed to be of most therapeutic benefit to a given patient.

For example, it may be desirable to exaggerate or under-correct ankle movements during particular phases of therapy. For example, stroke can cause upper neuron lesions in some patients which compromises inhibitory muscle controls; causing the patient to over-react in an opposing direction when a limb is moved or a joint flexed. Under-correction during early therapy seems to allow the body responses to be "coaxed" back to normal function. Conversely, exaggeration of motion is likely to be chosen with other stroke patients or patients with other maladies such as diabetic neuropathy where an exaggerated motion may be required to be learned to prevent dragging of the toes during the swing phase of a walking gait.

Once the flywheel position is translated to a chosen ankle angle corresponding to the particular position within the gait cycle, the servo motor 56 can be suitably energized in a manner well-understood in the art to rotate through an angle that drive the gears in gear box 54, depicted as the preferred worm and pinion sector gears as alluded to above. The rotational motion of the servo motor is reduced (and the torque correspondingly increased) by the preferably high gear ratio such that control arm 53 and pushrod 46, a portion of which is schematically depicted as a dashed line in FIG. 6, to control the angle of footplate 18 through control arm 44. Thus, as the footplates are carried through elliptical loci that achieve movements of the respectively portions of the legs in a substantially normal manner, the angle of the footplates can also be made to correspond to desired and therapeutic ankle angles appropriate to walking on a level surface. Ankle angle profile 36 of FIG. 3 is an example of how closely the ankle angle determined by the footplate can be made to correspond to ankle angles of normal walking on a level surface. It should be noted that the phase of the ankle angle can be made to exactly correspond to normal walking. Accurate mimicking of dorsiflexion in normal walking profile 32 can also be observed from profile 36. Plantarflexion is not mimicked closely in profile 36 only because the angular range of motion of footplate 18 is limited by the limited design height of element 42 as discussed above in connection with FIG. 4 but can, in fact, be mimicked as well if suitable clearance for the footplate is provided. However, the inventors have found that this limitation does not significantly compromise stroke patient therapy. Walking on inclined surfaces or surfaces presenting obstacles can also be simulated with high fidelity since substantially any ankle angle profile can be accommodated by the invention through the translation function 67. The resolution of ankle angle achieved by the invention is potentially very high since the resolution of rotational motion of the flywheel is also very high It should also be appreciated that, in contrast with other currently available apparatus for performing similar therapy that are entirely motor driven, the invention is entirely propelled by the user except for the servo motor for following the desired ankle angle profile. The invention thus provides a robotic device which follows a motion of the user (e.g. in pressing on the footplates 18) with a corresponding, different movement. Therefore, the invention can operate at any pace the user adopts and provides enhancement of both the exercise and therapeutic benefits of use. Perhaps more importantly, the propulsion of the invention principally by the user is believed to enhance therapy since control of forces produced by a non-parietal limb appear to force embedding of a movement pattern in the complementary impaired parietal limb. The invention can also operate in a reverse direction of the flywheel and thus can simulate walking backwards which is also believed to be of substantial therapeutic and exercise value.

In the preferred embodiment, closed-loop control is achieved by linking an embedded controller 75 (for example, Mbed™-NXP LPC 1768) to the servo motor controller(s) 56 (for example, Parker Aries series—ACR04CE) of the device via, for example, a TCPIP connection. Data from the load cell 59 is indexed to the motion profile and captured by the embedded controller. These data are compared to a normal force profile (which is also preferably stored on the embedded controller). When the load cell force exceeds a "normal" force, the embedded controller commands the servo motor controller to increase footplate attenuation (decreasing its motion gradually). When the force level from the load cell falls below a "normal" force threshold, the embedded controller commands the servo motor controller to decrease the attenuation level (increasing the motion gradually towards the normal profile).

A normal force profile, which is a profile of forces or torques associated with normal/healthy gait and/or reduced spasticity, can be produced and stored in the control system (e.g. in the embedded controller) by collecting baseline force data from a group of users with healthy gait using the device. This is preferably done with a user's feet positioned so that the lateral malleolus is in line with the rotational axis of the foot plate. This data is then normalized by subject body weight.

In some embodiments, the closed-loop control system may have/exhibit hysteresis. An upper limit to a "normal" force range may be set such that increased attenuation by a servo motor occurs after a load cell force exceeds the upper limit. Likewise, a lower limit to a "normal" force range may be set such that decreased attenuation occurs after a load cell force falls below the lower limit.

In the preferred embodiment, the left and right sides of the invention (that is, the left footplate and the right footplate) are operated/managed separately. That is to say, a separate/independent closed-loop control system is provided for each extremity, or alternatively, one closed-loop control system may be provided which regulates a left and right side independently of one another.

As perfecting features of the invention which are not necessary to the practice of the invention in accordance with its basic principles but which are desirable in a therapeutic environment where a user may continue therapy substantially unattended, a brake or locking mechanism 70 that can be electrically actuated by switch 74 through connection 72 can be employed at any point in the mechanical linkage discussed above, such as at flywheel 11, to allow the user to quickly halt operation if desired or in the event of loss of balance or proper positioning on the apparatus such as disengagement of a foot from a footplate 18. Since foot/ankle angle change is determined by flywheel motion, when the flywheel (or other part of the mechanism) is stopped, the elliptical footplate motion is also stopped and the footplate is essentially locked in angular position by the mechanical advantage provided by the worm and sector/pinion gears, as alluded to above. It is also desirable to provide for suspension of the user to the extent of at least a small portion of body weight with a harness that will carry the entire body weight of the user if the user begins to fall from the apparatus. Such a harness is also useful for therapists in initially positioning a non-ambulatory patient in the correct position on the apparatus.

In view of the foregoing, it is clearly seen that the invention provides an inexpensive and low weight apparatus for providing enhanced therapy for victims of stroke and other maladies which have impaired muscle control to the point of compromising the ability to walk. Any desired profile of ankle angle over the course of a gait movement can be accommodated to provide enhanced therapeutic treatment as the condition of the user may require. Cost and weight may be minimized by constructing the invention by modification of a commercially available exercise apparatus by the simple installation of a modular device as shown in FIG. 5 thereon. The invention may also be used as an addition to any lower extremity robotic assist device for post-stroke rehabilitation. In some embodiments, the invention may be considered an improvement of such devices. The apparatus in accordance with the invention is driven by the user and power is only required for angular movement of the footplates. The principles of the invention can also be applied to other repetitive movements and movement skills.

The invention may be used in the treatment of symptoms of stroke or other conditions which require rehabilitation, correction, strengthening, or normalization of the lower extremity, gait spasticity reduction etc. The invention is particular suited to use in facilitated (assisted) and/or automated therapy, and/or as a component when designing and building rehabilitation tools.

Figure 7:
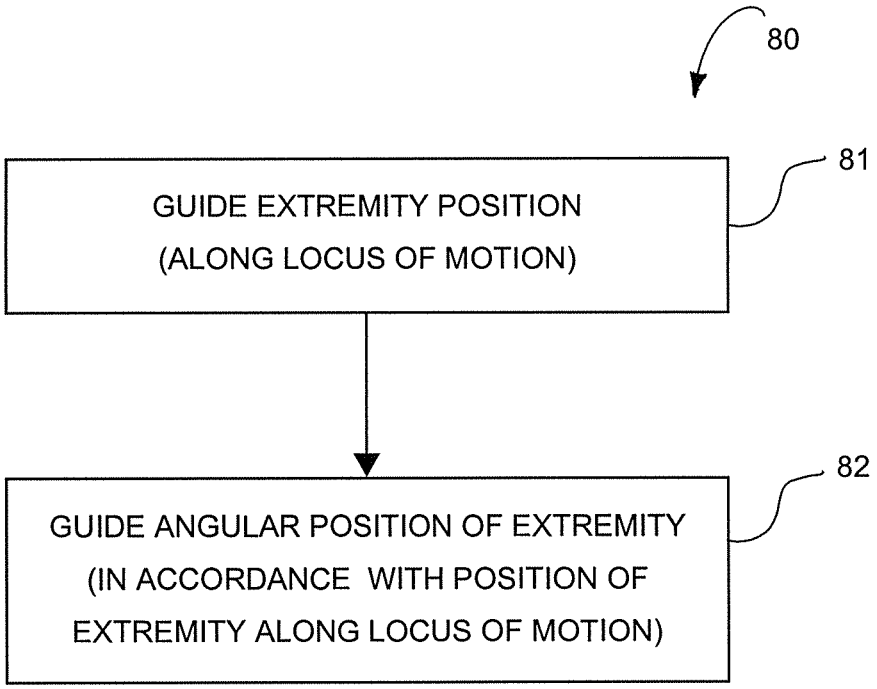
FIG. 7 is an exemplary method for providing physical therapy.

Referring now to FIG. 7, the invention provides a method 80 of providing rehabilitation therapy using an exercise apparatus such as that which is shown in FIG. 2B modified to include features shown in FIGS. 5 and 6. In a first step 81, an extremity of a subject's body is guided along a locus of motion. In the case of gait rehabilitation, a leg/foot is guided along a locus of substantially elliptical repetitive motion. Guiding the leg/foot along such a locus mimics normal ambulation, as shown and discussed above in reference to FIG. 1. In a second step 82, an angular position of the extremity is guided in accordance with a position of the extremity along the locus of motion. In the case of gait rehabilitation, this involves matching an ankle angle in the sagittal plane with a point in the gait cycle. As the point in the gate cycle derives from step 81, step 82 necessarily depends on the result of step 81. A closed-loop control system can be used to regulate the angular position guidance in step 82. Force feedback control from the closed-loop control system can reduce or avoid a spastic response in the patient during physical therapy. In practice, physical therapy method 80 entails time-continuous implementation of steps 81 and 82 for a duration of the physical therapy session. Method 80 may be performed with or without the aid of a physical therapist. That is to say, both facilitated and automated therapy are possible according to the method disclosed.

While the invention has been described in terms of its preferred embodiments, those skilled in the art will recognize that the invention can be practiced with modification within the spirit and scope of the appended claims.

Having thus described our invention, what we claim as new and desire to secure by Letters Patent is as follows:

1. Apparatus comprising in combination a mechanism for moving an extremity of a limb along a substantially elliptical locus, a sensor for determining locations of a portion of said mechanism along said substantially elliptical locus, an actuator responsive to said sensor for guiding an angular position of said extremity that simulates a repetitive motion of said limb corresponding to respective positions of said extremity along said substantially elliptical locus whereby said angular position of said extremity and said position of said extremity along said elliptical locus are decoupled and said angular position freely established for each position on said substantially elliptical locus, and a closed-loop control system which regulates an attenuation level of responsiveness of said actuator to said sensor in accordance with a change of force of said extremity against said portion of said mechanism.

2. The apparatus as recited in claim 1, wherein said closed-loop control system modifies said angular position of said extremity as guided by said actuator.

3. The apparatus as recited in claim 1, further comprising one or more force transducers for determining a force experienced by said mechanism from said extremity.

4. The apparatus as recited in claim 3, wherein an output of said one or more force transducers serves as an input to said closed-loop control system.

5. The apparatus as recited in claim 1 wherein said angular position of said extremity and position of said extremity along said elliptical path are substantially matched in phase to a natural repetitive action of a human body.

6. The apparatus as recited in claim 1 wherein said angular position of said extremity and position of said extremity along said elliptical path are substantially matched in profile to a natural repetitive action of a human body.

7. A robotic module for attachment to an exercise apparatus, said module comprising a sensor for determining locations of a extremity of a person along a substantially elliptical locus of repetitive motion of a limb, an actuator responsive to said sensor for guiding a an angular position of said extremity that simulates a repetitive motion of said extremity corresponding to respective positions of said extremity along said substantially elliptical locus whereby said angular position of said extremity and said position of said extremity along said elliptical locus are decoupled and said angular position freely established for each position on said substantially elliptical locus, and a closed-loop control system which regulates an attenuation level of responsiveness of said actuator to said sensor in accordance with a change of force of said extremity against said portion of said mechanism.

8. The robotic module as recited in claim 7 wherein said angular position of said extremity and position of said extremity along said elliptical path are substantially matched in profile to a natural repetitive action of a human body.

9. The robotic module as recited in claim 7 wherein said angular position of said extremity and position of said extremity along said elliptical path are substantially matched in phase to a natural repetitive action of a human body.

10. The robotic module as recited in claim 7, wherein said closed-loop control system modifies said angular position of said extremity as guided by said actuator.

11. The robotic module as recited in claim 7, further comprising one or more force transducers for determining a force experienced by said mechanism from said extremity.

12. The robotic module as recited in claim 11, wherein an output of said one or more force transducers serves as an input to said closed-loop control system.

13. A method of providing physical therapy using an exercise apparatus, said method comprising steps of guiding an extremity of a human body along a locus of substantially elliptical repetitive motion with said exercise apparatus, and guiding angular position of said extremity in accordance with a position of said extremity along said locus of substantially elliptical repetitive motion such that relative motions of a limb and said extremity are correlated in phase or profile to simulate a natural repetitive action of said human body, wherein said guiding angular position step is regulated by a closed-loop control system.

* * * * *